US006201225B1

(12) United States Patent
Lee

(10) Patent No.: US 6,201,225 B1
(45) Date of Patent: Mar. 13, 2001

(54) AIR DUCT IN MULTI-PURPOSE MICROWAVE OVEN

(75) Inventor: Sung Geon Lee, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/609,537

(22) Filed: Jun. 30, 2000

(30) Foreign Application Priority Data

Jul. 6, 1999 (KR) ..... 27086/1999

(51) Int. Cl.[7] ..... H05B 6/64

(52) U.S. Cl. ..... 219/757; 219/758; 126/21 A; 362/92

(58) Field of Search ..... 219/757, 758; 126/21 R, 21 A; 362/92

(56) References Cited

U.S. PATENT DOCUMENTS 5,847,377 * 12/1998 Yang et al. ..... 219/757

FOREIGN PATENT DOCUMENTS 63-189714 * 8/1988 (JP) ..... 219/758
5-10532 * 1/1993 (JP) ..... 219/757
6-94243 * 4/1994 (JP) ..... 219/757

* cited by examiner

*Primary Examiner*—Philip H. Leung
(74) *Attorney, Agent, or Firm*—Fleshner & Kim, LLP

(57) ABSTRACT

An air duct in a multi-purpose microwave oven is disclosed, which prevents an oven lamp from being overheated. The air duct in a multi-purpose microwave oven includes a main body having an air inlet and an air outlet to communicate a cooking chamber with a component chamber, a partition provided on an inner space of the main body to guide air flow into a first path located at the air inlet and a second path communicated with the cooking chamber, an air discharge opening formed on a wall on the first path to communicate with the outside, an oven lamp provided in the first path, and a closing device provided between the first path and the second path, for selectively blocking air flow into the second path so that air flown into the main body is selectively discharged through the air outlet or the air discharge opening.

4 Claims, 6 Drawing Sheets

AIR DUCT IN MULTI-PURPOSE MICROWAVE OVEN

BACKGROUND OF THE INVENTION

1. Field of the Invention

The present invention relates to a multi-purpose microwave oven, and more particularly, to an air duct in a multi-purpose microwave oven in which an oven lamp is provided in an air duct and cooled by flow air passing through the air duct so as not to be overheated by self-heat and external heat.

2. Discussion of the Related Art

Generally, a microwave oven is a cooking machine which cooks food by friction heat between molecules as arrangement of molecules is deranged using high frequency of about 2,450 MHz as a heat source. Particularly, a multi-purpose microwave oven has a convection function and a combination function as well as a microwave function. The convection function is performed in such a manner that food is cooked at hot air by heat of a heater. The combination function combines the microwave function with the convection function.

The multi-purpose microwave oven will be described with reference to FIGS. 1 and 2.

As shown in FIGS. 1 and 2, the multi-purpose microwave oven includes a main body 1, a base plate 2 on which the main body 1 is mounted, a U-bended outer case 3 which covers an upper part and both sides of the main body 1, a door 4 and a control panel 5. The door 4 and the control panel 5 are mounted at the front of the main body 1.

A cooking chamber 10 is provided at one side inside the main body 1, and a component chamber 11 is provided at the other side inside the main body 1. Various components required to drive the microwave oven are collected in the component chamber 11.

Furthermore, a tray 12 is provided on the bottom inside the cooking chamber 10 and rotated by a motor (not shown) to evenly heat food put on the tray. A heater 13 is provided on an upper part outside the cooking chamber 10. The heater 13 emits heat when the convection function is operated so that the heat of the heater 13 flows into the cooking chamber 10 through a porous part 10*a* which is formed on a top surface of the cooking chamber 10.

Main components such as a transformer 21 and a magnetron 20 which is a high frequency oscillator are provided in the component chamber 21. The transformer 21 transforms power source for home use to high voltage required to oscillate the magnetron 20. Furthermore, a cooling pan 22, a waveguide 23, and an air duct 24 are provided in the component chamber 21. The cooling pan 22 includes a pan motor for cooling high heat generated when oscillating the magnetron 20. The waveguide 23 guides microwave generated by the magnetron to the cooking chamber 10. The air duct 24 guides air generated by rotative force of the cooling pan to the cooking chamber 10.

In the aforementioned multi-purpose microwave oven, to heat/cook food, in a state that the cooking chamber 10 is opened by opening the door 4, cooking food is put on the tray 12 and then the door 4 is closed to seal the cooking chamber 10.

Subsequently, one of the microwave function, the convection function and the combination function is selected in accordance with food type and food state, so that the microwave oven is operated.

For example, if the microwave function is selected, high frequency of about 2,450 MHz per second is oscillated from the magnetron 20 and propagated into the cooking chamber 10 through the waveguide 23. The high frequency propagated into the sealed cooking chamber 10 is scattered and reflected on the wall of the cooking chamber 10 to be incident upon the food. Thus, arrangement of molecules of the food is deranged. For this reason, friction heat between the molecules is generated so that the food is heated and cooked.

If the convection function is selected, the heater 13 emits heat and the heat of the heater 13 flows into the cooking chamber 10 through the porous part 10*a*. Thus, the food is heated by the convection. In this case, to preserve a temperature in the cooking chamber, the air duct 24 is closed so as not to flow air generated by the cooling pan 22 from the component chamber 11 into the cooking chamber 10. To this end, a damper 26 is provided in the air duct 24 and is controlled by a solenoid 25.

Meanwhile, a porous part 14*a* is formed in a partition 14 which isolates the cooking chamber 10 from the component chamber 11. An oven lamp 27 is formed at a side of the component chamber 11 next to the porous part 14a so as to illuminate the cooking chamber 10 through the porous part 14*a*.

Particularly, to improve illuminance, the oven lamp 27 is mounted in a stainless lamp box 28 having excellent reflexibility. A heat blocking plate 29 is provided at a side of the lamp box 28 to block cooking heat generated during cooking (see FIG. 2).

However, as heat emitted from the oven lamp 27 is combined with cooking heat, heat of about 200° C. is actually conducted to the heat blocking plate 29. As a result, the heat blocking plate 29 has poor heat blocking function. This often shorts the oven lamp 27, reduces its service life, and incurs the A/S cost.

Furthermore, since the air duct 24 is separated from the oven lamp 27, the volume of the microwave oven increases and the number of components increases, thereby causing adverse effect in price competition.

SUMMARY OF THE INVENTION

Accordingly, the present invention is directed to an air duct in a multi-purpose microwave oven that substantially obviates one or more of the problems due to limitations and disadvantages of the related art.

An object of the present invention is to provide an air duct in a multi-purpose microwave oven which prevents an oven lamp from being overheated.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, an air duct in a multi-purpose microwave oven according to the present invention includes a main body having an air inlet and an air outlet to communicate a cooking chamber with a component chamber, a partition provided on an inner space of the main body to guide air flow into a first path located at the air inlet and a second path communicated with the cooking chamber, an air discharge opening formed on a wall on the first path to communicate with the outside, an oven lamp provided in the first path, and a closing means provided between the first oath and the second path, for selectively blocking air flow into the second path so that air flown into the main body is selectively discharged through the air outlet or the air discharge opening.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Figure 1:
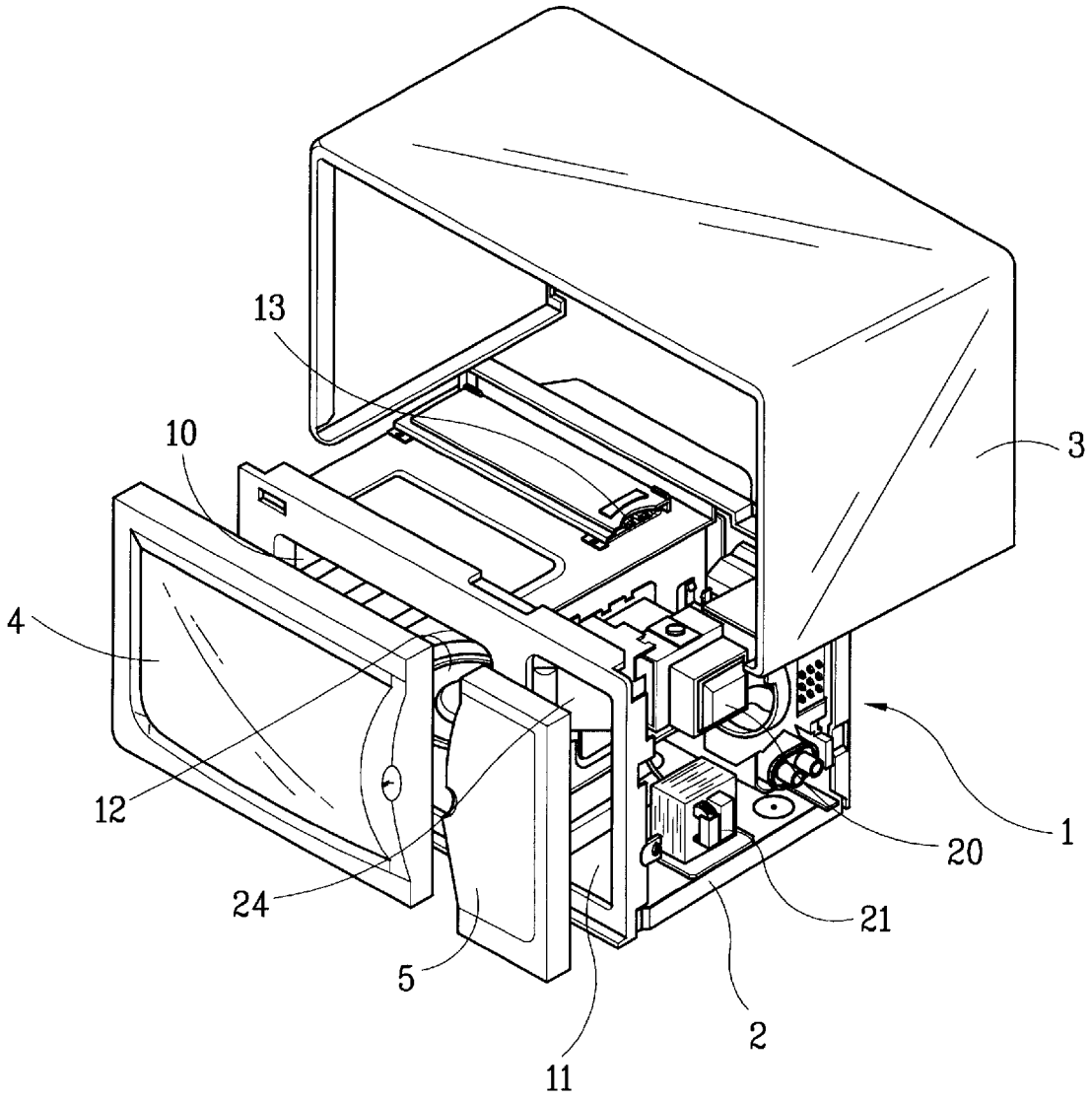
FIG . 1 Related Art
FIG. 1 is an exploded perspective view showing a general multi-purpose microwave oven.
Figure 2:
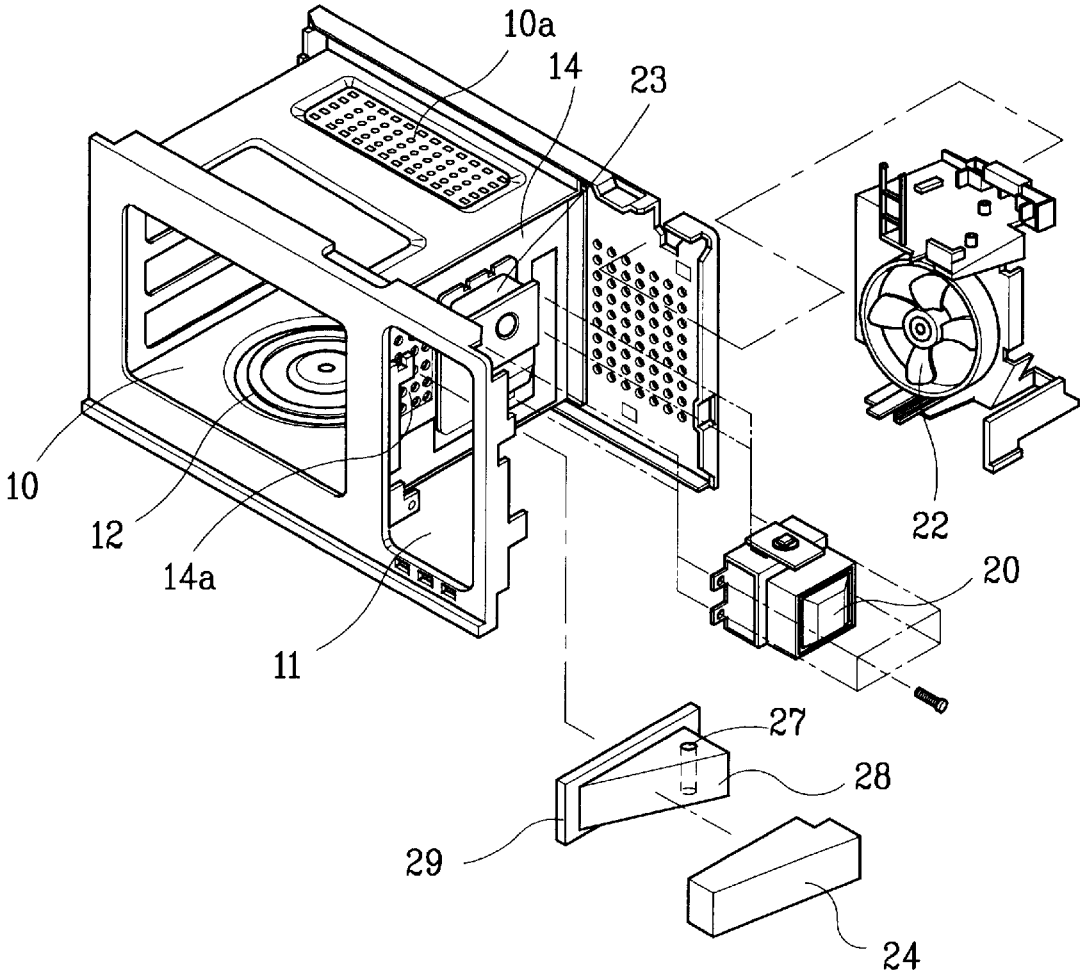
FIG . 2 Related Art
FIG. 2 is a main part perspective view showing a multi-purpose microwave oven.
Figure 3:
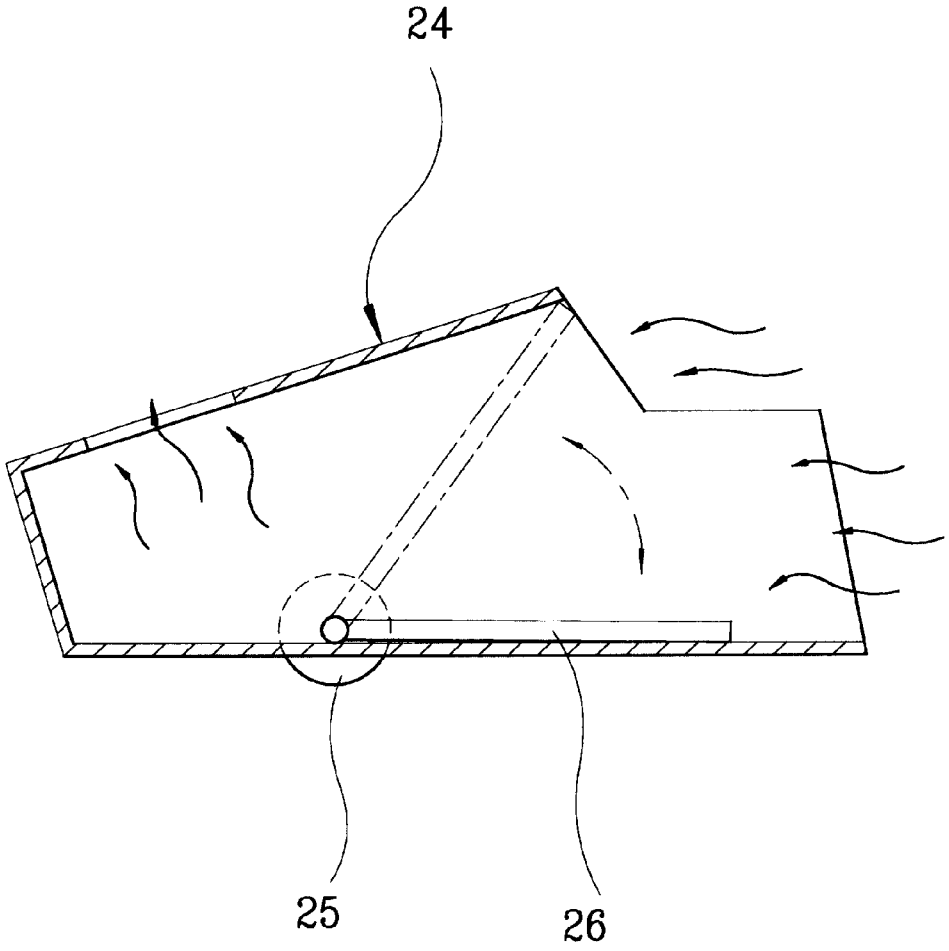
FIG . 3 Related Art
FIG. 3 is a cross-sectional view showing a related art air duct.
Figure 4:
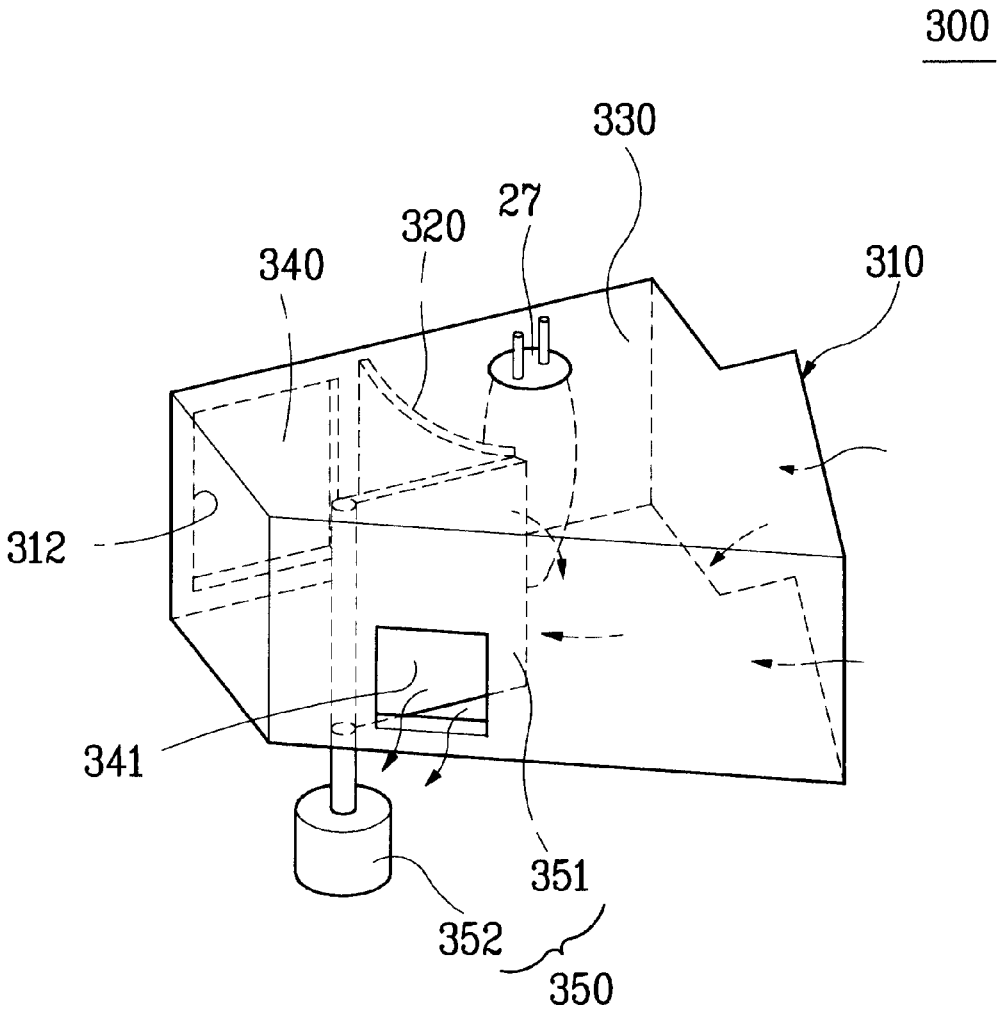
FIG. 4 is a perspective view of an air duct according to the present invention.
Figure 5:
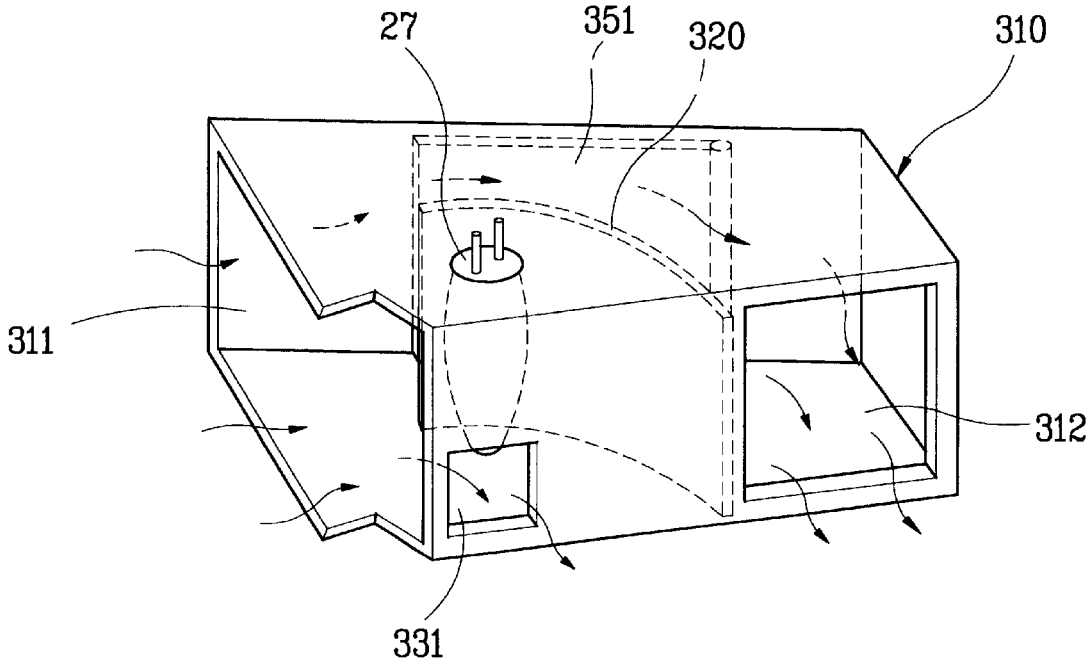
FIG. 5 is a perspective view viewing along line A of FIG. 4.

Reference will now be made in detail to the preferred embodiments of the present invention, examples of which are illustrated in the accompanying drawings.

Unlike the related art air duct, an air duct of the present invention is intended that an inner space of a main body formed to communicate between a cooking chamber and a component chamber is divided into two paths, and an oven lamp is provided on one of the paths, thereby selectively controlling air flow to the paths.

The air duct of the present invention will now be described in detail.

The air duct 300 of the present invention includes a main body 310 having an air inlet 311 and an air outlet 312 to communicate between a cooking chamber 10 and a component chamber 11. A partition 320 is provided on an inner space of the main body 310. The partition 320 acts to divide the inner space of the main body 310 into a first path 330 and a second path 340. The first path 330 is located at a side where the air inlet 311 of the main body 310 is formed. The second path 340 is located at an opposite side of the air inlet 311. That is to say, the second path 340 is located at a side where the air outlet 312 of the main body 310 is formed.

Furthermore, a first air discharge opening 331 communicated with the outside is formed on a wall on the first path 330, and a second air discharge opening 341 communicated with the outside is formed on a wall on the second path 340. An oven lamp 27 is provided near the first air discharge opening 331 formed in the first path 330 so that the air discharged through the first air discharge opening 331 passes through the oven lamp 27.

Meanwhile, the partition 320 extends along air flow direction from the wall where the first air discharge opening 331 of the first path 330 is formed, and is curved toward an opposing wall. Thus, the flow air is guided more smoothly.

A closing means 350 is provided in the second path 340. The closing means 340 is selectively operated so that the air flown into the main body 310 is discharged to the outside of the main body 310 through the air discharge openings 331 and 341 or the air is discharged into the cooking chamber 10 through the air outlet 312. At the same time, the closing means 350 is operated to selectively close the second path 340.

The closing means 350 includes a flat type damper 351 and a solenoid 352 for selectively rotating the damper 351. The damper 351 is closely adhered on the inner wall of the second path 340 if the second path 340 is opened. The damper 351 contacts the end of the partition 320 to block air flow into the second path 340 if the second path 340 is closed.

The second air discharge opening 341 is located on the inner wall of the second path 340 on which the damper 351 is selectively adhered, so that the second air discharge opening 341 is closed by the damper 351 if the second path 340 is opened while the second air discharge opening 341 is opened if the second path 340 is closed.

The operation of the aforementioned air duct will be described.

As aforementioned, the multi-purpose microwave oven has a microwave function, a convection function and a combination function. In addition to these functions, the multi-purpose microwave oven has a convection 250° C. function.

Figure 6A:
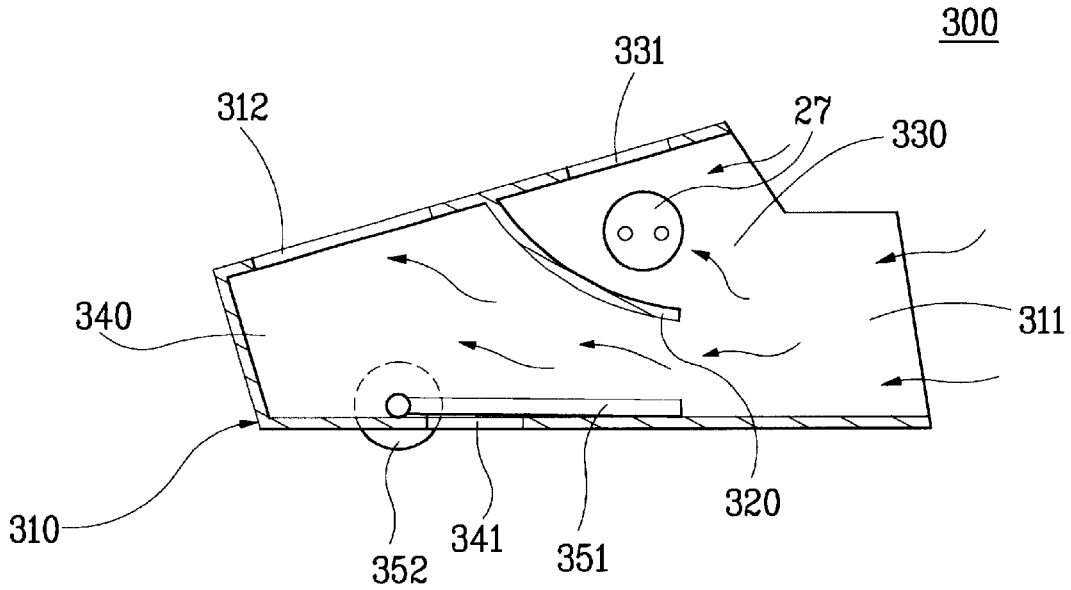
FIG. 6*a* is a cross-sectional view of an air duct showing a state that a path communicated to a cooking chamber is open.

If the microwave function is operated, as shown in FIG. 6*a*, vapor evaporated from cooking food in the cooking chamber 10 is emitted in a door window 4*a*. Thus, it is difficult to confirm cooking progress situation through the door window. In this case, the air duct 300 is opened to flow air of high temperature passed through the magnetron 20 into the cooking chamber 10, thereby removing vapor. To this end, the damper 351 hinge-coupled to one side at the inner wall of the second path 340 is closely adhered on the wall of the second path 340 so as to communicate the component chamber 11 and the cooking chamber 10 with each other.

In other words, it is intended that the flow air generated from the component chamber 11 flows into the cooking chamber 10 through the air outlet 312 located on the second path 340. At this time, the damper 351 closes the second air discharge opening 341 formed on the wall of the second path 340. In this case, air discharge to the outside through the second air discharge opening 341 is not performed.

If the second air discharge opening 341 is opened, the air is discharged through the second air discharge opening 341, thereby reducing air flow into the cooking chamber 10 and reducing vapor removing efficiency in the cooking chamber 10. Accordingly, if the second path 340 is opened, the air discharge through the second air discharge opening 341 is closed and at the same time the air flown through the air inlet 311 flows into the cooking chamber 10 through the air outlet 312.

Meanwhile, since no open and close means is provided in the first path 330, the air flown into the air inlet 311 passes through the oven lamp 27 and is discharged to the outside through the first air discharge opening 331. In this process, the oven lamp 27 is cooled by air of a relatively low temperature passing through the first path 330, so that the oven lamp 27 is prevented from being damaged by heat. This prevents the oven lamp 27 from being shorted and also prevents its service life from being reduced due to external heat (heat conducted from the cooking chamber) and self-heat.

On the other hand, the convection 250° C. function or the convection function is performed when baking bread and the like. That is to say, cooking is performed by heat of the heater. For example, since food such as bread is baked by the heater 13, vapor is not almost emitted. Thus, it does not matter even if air does not flow into the cooking chamber 10. Also, since the convection function enables cooking by heat of the heater, a temperature in the cooking chamber 10 should be maintained.

Figure 6B:
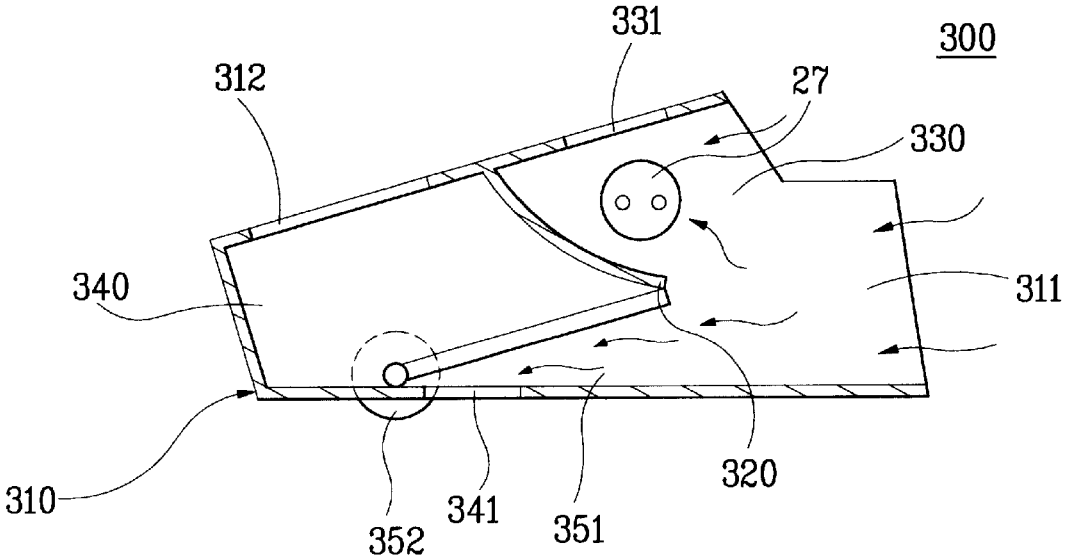
FIG. 6*b* is a cross-sectional view of an air duct showing a state that a path communicated to a cooking chamber is close.

For this reason, as shown in FIG. 6*b*, the damper 351 closes a communication portion between the first path 330 and the second path 340 so that the air flow is blocked from the component chamber 11 to the cooking chamber 10. At this time, the damper 351 blocks the communication portion by closely adhering its free end to the end of the partition 320 around a hinge end by driving of the solenoid 352.

At the same time, the second air discharge opening 341 closed by the damper 351 is opened so that the air is discharged through the second air discharge opening 341.

That is to say, the air flown through the air inlet 311 is discharged to the outside through the second air discharge opening 341 in a state that the air flow to the second path 340 is blocked by the damper 351.

Meanwhile, when the convection function is operated, the first path 330 is always open in the same manner as the microwave function. Accordingly, the oven lamp 27 is to be cooled.

The aforementioned air duct in a multi-purpose microwave oven has the following advantages.

The inner space of the air duct is divided into two. Either of them selectively opens and closes the component chamber and the cooking chamber. The other is provided with the oven lamp so that the air generated from the component chamber continuously flows. Thus, the path communicated to the cooking chamber is selectively blocked and at the same time the oven lamp is cooled. Moreover, since the oven lamp is provided in the air duct in an integral form, a small number of components are required, thereby enabling the slim sized product. Thus, productivity and price competition can be improved.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An air duct in a multi-purpose microwave oven comprising:

a main body having an air inlet and an air outlet to communicate a cooking chamber with a component chamber;

a partition provided on an inner space of the main body to guide air flow into a first path located at the air inlet and a second path communicated with the cooking chamber;

an air discharge opening formed on a wall on the first path to communicate with the outside;

an oven lamp provided in the first path; and a closing means provided between the first path and the second path, for selectively blocking air flow into the second path so that air flown into the main body is selectively discharged through the air outlet or the air discharge opening.

2. The air duct of claim 1, wherein the closing means is rotatably mounted on an inner wall of the main body between the partition and the second path.

3. The air duct of claim 2, further comprising a separate air discharge opening communicated with the outside of the main body on the inner wall of the main body on which the closing means is adhered in a state that the respective paths communicate each other.

4. The air duct of claim 1, wherein the partition extends from a wall where the air discharge opening of the first path is formed, and is curved toward an opposing wall.

* * * * *